US009967932B1

(12) United States Patent
Yao

(10) Patent No.: US 9,967,932 B1
(45) Date of Patent: May 8, 2018

(54) POWER SUPPLY TRANSIENT REDUCTION METHOD FOR MULTIPLE LED CHANNEL SYSTEMS

(71) Applicant: Integrated Silicon Solution, Inc., Milpitas, CA (US)

(72) Inventor: ChungTing Yao, Saratoga, CA (US)

(73) Assignee: Integrated Silicon Solution, Inc., Milpitas, CA (US)

( * ) Notice: Subject to any disclaimer, the term of this patent is extended or adjusted under 35 U.S.C. 154(b) by 0 days. days.

(21) Appl. No.: 15/629,112

(22) Filed: Jun. 21, 2017

Related U.S. Application Data

(63) Continuation of application No. 15/295,800, filed on Oct. 17, 2016, now Pat. No. 9,717,123.

(51) Int. Cl.
*H05B 33/08* (2006.01)

(52) U.S. Cl.
CPC ..... *H05B 33/0815* (2013.01); *H05B 33/0827* (2013.01); *H05B 33/0845* (2013.01)

(58) Field of Classification Search
CPC ..... H05B 33/08; H05B 33/0809; H05B 33/0815; H05B 33/0827; H05B 33/0845; H05B 33/0887; H05B 33/083; H05B 33/089; H05B 37/02
USPC ..... 315/185 R, 192, 196, 209 R, 224–226, 315/291, 297, 307, 308, 312
See application file for complete search history.

(56) References Cited

U.S. PATENT DOCUMENTS

| | | | | |
|---|---|---|---|---|
| 8,994,277 | B2 | 3/2015 | Yang | |
| 9,320,097 | B2 | 4/2016 | Zhang | |
| 2007/0262724 | A1 | 11/2007 | Mednik | |
| 2011/0068700 | A1* | 3/2011 | Fan | H05B 33/0818 315/185 R |
| 2012/0038292 | A1 | 2/2012 | Kuo | |
| 2012/0104964 | A1 | 5/2012 | Hughes | |
| 2012/0194087 | A1 | 8/2012 | Lu | |
| 2012/0235596 | A1 | 9/2012 | Yao | |
| 2013/0082613 | A1 | 4/2013 | Shin | |

* cited by examiner

*Primary Examiner* — Jimmy Vu
(74) *Attorney, Agent, or Firm* — Innovation Counsel LLP

(57) ABSTRACT

An LED controller for a multiple LED channel system using PWM method for LED dimming function incorporates a digital dimming control circuit to generate the PWM signals for driving the LED channels to spread out or cancel out the power supply transients generated by the LED transient current during PWM modulation for dimming operation. The digital dimming control circuit implements a power supply transient reduction method whereby the active period of the PWM signals for some of the LED channels are shifted within the switching cycle to align at least some of the rising signal edges with some of the falling signal edges so as to cancel out the voltage transients on the LED power rails generated at the signal transitions. Furthermore, the rising and falling signal edges that are not lined up are spread out through the PWM switching cycle so that the power supply transients are spread out.

20 Claims, 6 Drawing Sheets

POWER SUPPLY TRANSIENT REDUCTION METHOD FOR MULTIPLE LED CHANNEL SYSTEMS

CROSS REFERENCE TO OTHER APPLICATIONS

This application is a continuation of co-pending U.S. patent application Ser. No. 15/295,800, now U.S. Pat. No. 9,717,123, entitled AUDIBLE NOISE REDUCTION METHOD FOR MULTIPLE LED CHANNEL SYSTEMS filed Oct. 17, 2016 which is incorporated herein by reference for all purposes.

BACKGROUND OF THE INVENTION

Incandescent light bulbs are quickly being replaced by light-emitting diodes (LEDs), in particular, in automotive market. This is because LED technology provides greatly improved energy efficiency, better reliability, lowered cost and smaller form factor compared with incandescent light bulbs. LEDs are typically packaged as surface-mount device (SMD) which allows for high volume, low cost printed circuit board (PCB) manufacturing along with ever advanced semiconductor technology, further reducing production cost. LED lighting generates less heat which further reduces environment cooling requirement and cost. With LED integration into the automotive market, fuel efficiency can be improved for longer cruising range and lower fuel cost.

Many LED applications require a dimming function. One method of achieving LED dimming function is to adjust the LED forward current. However, it is well known that LED's light spectrum is also dependent on LED's forward current. Reducing the LED current to reduce LED brightness to achieve dimming function also unwantedly shifts the LED color, which is undesirable.

Therefore, LED dimming function is typically implemented using the PWM (Pulse Width Modulation) method where the nominal forward current is applied to the LED but the forward current is switched on and off periodically so that the root mean square (RMS) current value can be adjusted to the desired value. Because the forward current remains at same nominal current value, the LED color will remain the same across the full brightness controlled range. The PWM dimming frequency is usually above 100 to 120 Hz to avoid visual flickering, and a PWM dimming frequency of around 200 Hz is typically used. Although, higher frequencies can be used, high PWM switching frequency will have higher switching power loss, as well as more harmonic electromagnetic interference (EMI) emission into frequency range which may interfere with adjacent RF circuit operation.

FIG. 1 is a schematic diagram illustrating one example of an LED lighting application. Referring to FIG. 1, a string of LEDs 2 is connected to an LED controller 1. The LED string 2 is connected to a switch SW which is driven by a PWM signal, which can be either from the system control unit or from the LED controller itself. The LED controller 1 provides the forward current to the LED string 2. By turning the switch SW on and off at different duty cycle, the brightness emitted by the LED string can be controlled to achieve the dimming function. However, in the typical applications, implementing LED dimming by PWM switching sometimes leads to undesirable side effects.

In particular, the LED controller 1 receives a power supply voltage VDD. An input capacitor Cin is coupled to the power supply voltage VDD to filter out the power supply voltage. The input capacitor Cin is typically a low cost ceramic capacitor. When the dimming function is implemented, the PWM signal switches the LED forward current on and off at the same switching frequency if VDD regulation is not able to respond quickly enough. This pulsed current is seen by the ceramic input capacitor connected to the VDD power rail, causing the input capacitor to resonate mechanically due to the piezoelectric effect. With sufficiently large LED current being turned on or off, large voltage ripple can be developed on VDD power rail to cause the input capacitor to resonate at the PWM frequency, thereby generating audible noise since the PWM frequency is within the audible frequency range of human hearing.

The audible noise issue can be mitigated by using properly designed PCB layout and mechanical set up. For example, an LED lighting application can be implemented by placing two identical capacitors on both sides of PCB to cancel the piezoelectric effect. Alternately, the input capacitor mechanical resonance can be reduced by drilling holes besides the capacitor's soldering points. However, it is often not possible to implement these solutions as they require larger PCB layout and dual side surface-mount manufacturing adds component cost and production cost. In other examples, the ceramic input capacitor can be replaced by multilayer ceramic chip capacitor (MLCC) or electrolytic capacitor that does not exhibit piezoelectric behavior, thereby avoiding the audible noise altogether. However, these capacitors are more expensive than ceramic capacitors and therefore increases the component cost.

Another solution to the audible noise issue with LED dimming function involves the use of power supply voltage isolation and an output capacitor Cout coupled to the LED string, as shown in FIG. 2. FIG. 2 is a schematic diagram illustrating another example of an LED lighting application. Referring to FIG. 2, a string of LEDs 2 is connected to an LED controller 3. The LED string 2 is connected to a switch SW which is integrated into the LED controller 3 in the present example. Integrating the switch SW into the LED controller reduces component cost and also enables more precise control of the LED current, such as by use of a constant current source. The switch SW is driven by a PWM signal to switch the LED forward current on and off to achieve the dimming function. The LED controller 3 receives a power supply voltage VDD which is also coupled to an input capacitor Cin. The LED controller includes a voltage regulation circuit 4 to isolate the anode of the LEDs (node 5) from the power supply voltage VDD. An output capacitor Cout is connected in parallel to the LED string 2. Accordingly, voltage ripple at the input capacitor is eliminated by the use of the voltage regulation circuit 4 and the output capacitor Cout absorbs the power ripple across the LEDs 2. Examples of the voltage regulation circuit that can be incorporated into the LED controller include a low-dropout (LDO) voltage regulator, a charge pump, a buck regulator, or a boost regulator. Other voltage regulation circuits can also be used.

As thus configured, PWM function is achieved by turning switch SW on and off at the PWM frequency. Power ripple across the LED string 2 can be absorbed by the output capacitor Cout. When driving large LED current, the capacitance of the output capacitor Cout has to be increased proportionally, otherwise the voltage on Cout itself will generate ripple, becoming another audible noise source. In the application shown in FIG. 2, the current flowing into switch SW is identical to the current flowing into the LED string 2. When the LED current is large, the conduction loss incurred in switch SW can be large, causing system power loss. To minimize this conduction loss, the resistance of switch SW has to be minimized.

In many applications, the LED controller may be configured to drive multiple strings of LEDs. In some cases, the LED strings are powered directly by the power rail VDD and the LED controller controls the LED forward current to achieve constant current at each LED string. When multiple LED strings are used, the LED current becomes very large, which can cause large ripple on the power rail. Thus, the audible noise issue caused by the LED dimming function becomes even more serious.

Other solutions to the audible noise issue in LED dimming function include coupling a switch in series with the output capacitor, as described in U.S. Patent Publication Application No. 2012/0235596. Another solution involves shifting the PWM frequency to above the human audible range, that is, above 20 KHz, as described in U.S. Pat. No. 8,994,277. Although shifting the PWM frequency out of the human audible range can completely obviate the audible noise issue in LED dimming, this method is sometimes not desirable due to electromagnetic interference (EMI) concerns when the PWM frequency is shifted to a high frequency. Faster PWM frequency will also increase operation switching loss, reducing system power efficiency. Also, ripples on the VDD power rail still exists, which may affect other devices that are sharing the same power rail. In addition, for high contrast ratio applications, e.g., 5,000:1, the LED driver circuit may not be able to switch fast enough for such a high frequency operation.

In multiple LED string systems, it is possible to apply clock skewing to spread out the clock signal emitted power, thereby reducing the peak emitted power and reducing EMI effect. In LED applications, clock skewing refers to starting the PWM cycle for each LED channel at a different time so that the LED current will not be drawn from the power supply simultaneously by the multiple LED strings. In this manner, the power transients are spread out, thereby lowering the audible noise power. For example, clock skewing can be implemented by grouping LED strings into a set of channels with the clock signal for each channel being skewed by a certain amount of time. That is, the start time of the PWM cycle for each channel is offset from the other channels but the PWM duty cycle remains the same for all the channels. Although clock skewing can be used to alleviate the EMI concern, clock skewing has limited applications due to timing constraints. For example, clock skewing cannot be used in a multiple channel, RGB LED systems, the Red, Green and Blue LED must be operational at the same time frame without any timing skew for a proper color presentation.

BRIEF DESCRIPTION OF THE DRAWINGS

Various embodiments of the invention are disclosed in the following detailed description and the accompanying drawings.

DETAILED DESCRIPTION

Figure 1:
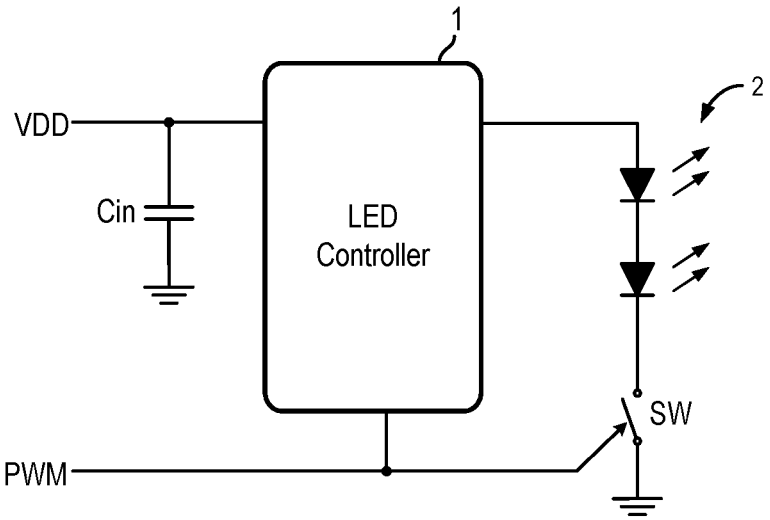
Fig. 1 (Prior Art)
FIG. 1 is a schematic diagram illustrating one example of an LED lighting application.
Figure 2:
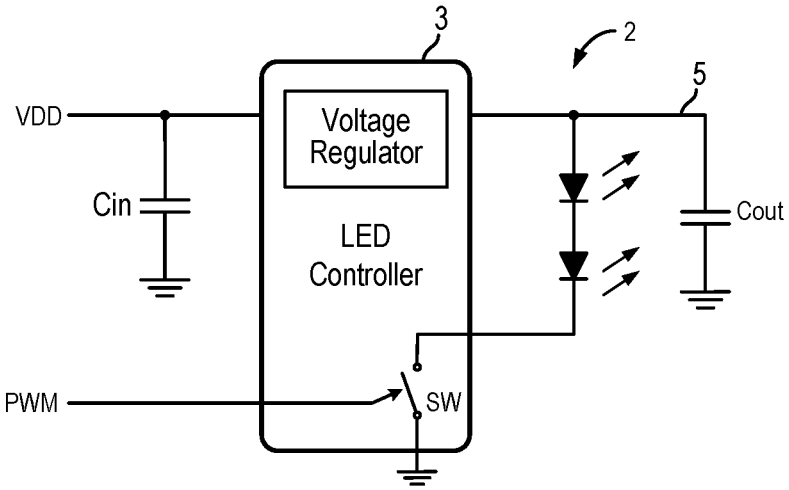
Fig. 2 (Prior Art)
FIG. 2 is a schematic diagram illustrating another example of an LED lighting application.

The invention can be implemented in numerous ways, including as a process; an apparatus; a system; and/or a composition of matter. In this specification, these implementations, or any other form that the invention may take, may be referred to as techniques. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

In embodiments of the present invention, an LED controller for a multiple LED channel system using PWM method for LED dimming function incorporates a digital dimming control circuit to generate the PWM signals for driving the LED channels to spread out or cancel out the power supply transients generated by the LED transient current during PWM modulation for dimming operation. The digital dimming control circuit generates PWM signals for driving each LED channel where the PWM signals have a duty cycle corresponding to the programmed LED brightness. The digital dimming control circuit implements an audible noise reduction method whereby the active period (or the duty cycle) of the PWM signals for some of the channels are shifted within the switching cycle to align at least some of the rising signal edges with some of the falling signal edges so as to cancel out the voltage transients on the LED power rails generated at the signal transitions. Furthermore, the rising and falling signal edges that are not lined up are spread out through the PWM switching cycle so that the power supply transients are spread out to reduce the peak amplitude of the voltage transients. Meanwhile, the duty cycle of each of the PWM signals is maintained to be the same so that the programmed brightness level is not affected by shifting of the signal edges. Because voltage transients are the root cause of the audible noise issue in LED systems, by reducing or eliminating the power rail voltage transients, the digital dimming control circuit of the present invention effectively reduces or eliminates the audible noise generated due to PWM dimming operations, minimizing EMI concerns with increased PWM frequency and without using higher cost components.

In some embodiments, the digital dimming control circuit generates the PWM signal for some LED channels having the leading edge being fixed and the trailing edge being modulated and generates the PWM signal for other LED channels having the leading edge being modulated and the trailing edge being fixed. The fixed leading and trailing clock edges of the PWM signals are lined up so as to cancel the power supply voltage transients or ripples. Since the audible noise power is a function of the square of the transient voltage amplitude, reducing the power supply voltage transients has the effect of dramatically reducing the audible noise generated therefrom.

Figure 3:
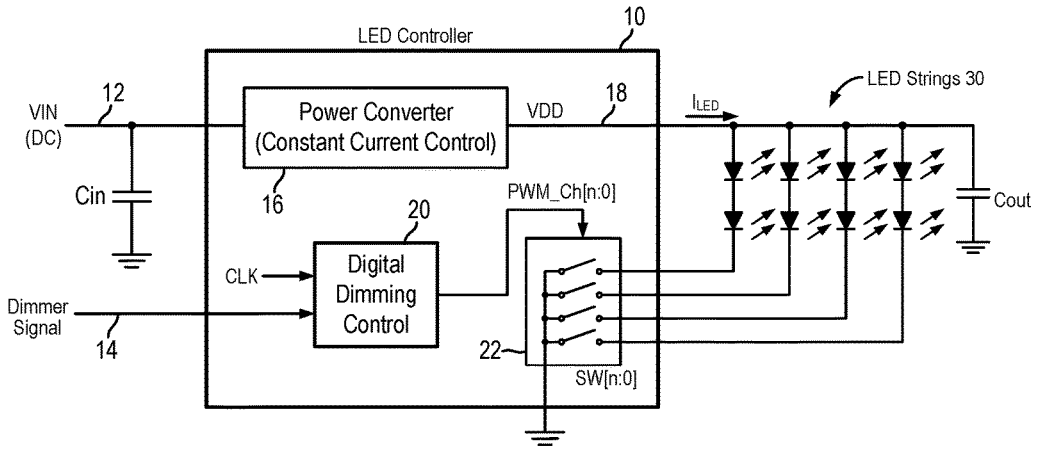
FIG. 3 is a schematic diagram illustrating an LED controller for a multiple LED channel system incorporating a digital dimming control circuit in embodiments of the present invention.

FIG. 3 is a schematic diagram illustrating an LED controller for a multiple LED channel system incorporating a digital dimming control circuit in embodiments of the present invention. Referring to FIG. 3, an LED controller 10 is configured to drive a multiple LED channel system including multiple LED strings 30 connected in parallel. The LED strings 30 are driven by the LED current $I_{LED}$ (node 18) provided by the LED controller 10. In the present embodiment, the multiple LED channel system includes four LED strings. In other embodiments, the multiple LED channel system may be constructed using any number of two or more LED strings. The LED strings 30 are grouped into two or more LED channels, where each LED channel can include one or more LED strings. In the present description, an LED channel refers to a group of one or more LED strings connected in parallel, where each LED string is formed by multiple light-emitting diodes connected in series.

The LED controller 10 receives an input voltage Vin as the input power supply on an input node 12. The input voltage VIN is a DC voltage. An input capacitor Cin is connected between the input voltage node 12 and ground. The LED controller 10 includes a power converter 16 coupled to receive the DC input voltage VIN and to generate the LED current $I_{LED}$ (node 18) for driving the LED strings 30. The power converter 16 generates an output voltage VDD on the controller output node 18 which is filtered by an output capacitor Cout. The output voltage VDD is the power rail voltage for the LED strings 30. In operation, the power converter 16 implements constant voltage control to generate a constant power supply voltage VDD to supply the LED strings 30. The LED strings 30 emits light at a specific light spectrum or color when the power rail voltage VDD exceeds the LED forward bias voltage. In embodiments of the present invention, the power converter 16 can be implemented as a linear voltage regulator or a switching voltage regulator. For example, the power converter 16 can be implemented as a low-dropout (LDO) voltage regulator, a charge pump, a buck regulator, or a boost regulator.

To implement LED dimming function, the LED controller 10 implements the Pulse Width Modulation (PWM) method where the nominal forward current is applied to the LED strings but the forward current is switched on and off at a PWM frequency to adjust the root mean square current value to obtain the desired brightness from each LED. More specifically, each LED string 30 is coupled in series with a switch SW which is controlled by a PWM signal. The PWM signal turns the switch SW on and off at a given duty cycle to allow the LED current to flow through the LED string or to stop the LED current. As a result, the LEDs in the LED strings are turned on or off at the PWM frequency as controlled by the PWM signal to emit light having the desired brightness. The brightness of LEDs is proportional to the average duty cycle of the PWM signal. So long as the average duty cycle is the same, human eyes cannot discern the switching action of the PWM dimming operation. In embodiments of the present invention, the PWM frequency is selected to be above 100 to 120 Hz to avoid visual flickering. In one embodiment, a PWM frequency of 200 Hz is used.

In the present embodiment, the PWM method is implemented using switches 22 that are integrated in the LED controller 10. The switches 22 include a set of (n+1) number of switches SW[n:0] for the (n+1) number of LED channels the LED controller 10 is driving. Each switch SWn is coupled to one channel of the LED strings 30. In the present embodiment, the LED strings 30 are illustrated as being organized in four channels, with each channel containing one LED string. Therefore, the switches 22 include a set of 4 switches. The LED system shown in FIG. 3 is illustrative only and not intended to be limiting. As described above, the LED system may contain any number of LED strings and each LED channel may contain one or more LED strings. To implement the LED dimming function, the switches SW[n:0] are driven by respective PWM signals PWM_Ch[n:0], with each switch being driven by one PWM signal. In general, the PWM signal are switched at a PWM frequency at a given duty cycle to achieve the desired brightness level emitted by the LED strings 30.

In embodiments of the present invention, the LED controller 10 includes a digital dimming control circuit 20 configured to generate multi-channel PWM signals PWM_Ch[n:0] for driving a multiple LED channel system in response to a dimmer signal. The digital dimming control circuit 20 receives the dimmer signal (node 14) as an input signal and also receives an input clock CLK. In one embodiment, the dimmer signal has a signal value corresponding to a desired light intensity level for the LED strings 30. In particular, the LED controller 10 is configured to drive the LED strings 30 over a set of light intensity levels, such as 256 or 1024 light intensity levels. The number of light intensity levels that can be driven by the LED controller 10 is determined by the PWM frequency and the speed of circuits in the LED controller. The digital dimming control circuit 20 generates the PWM signals PWM_Ch[n:0] switching at the PWM frequency and having a duty cycle that is proportional to the light intensity level as programmed by the dimmer signal. Importantly, the digital dimming control circuit 20 generates the PWM signals using an audible noise reduction method that reduces or eliminates audible noise, as will be explained in more detail below.

The operation of the LED controller 10 controlling the LED strings 30 is as follows. The power converter 16 generates a forward current $I_{LED}$ to drive the LED strings 30 when the power supply voltage VDD exceeds the LED string's total forward bias voltage. Because the forward current remains at same nominal current value which is designed to be controlled by the LED controller, the LED color will remain the same across the full brightness controlled range. Meanwhile, in response to the dimmer signal, the digital dimming control circuit 20 generates the PWM signals PWM_Ch[n:0] having a given duty cycle or on time to turn the switches SW[n:0] on and off at a switching frequency (or PWM frequency). As a result, the LEDs in the LED strings 30 are being turned on and off in response to the PWM signals. While the color of the LED emitted light is a function of the LED forward current, the brightness of the LED emitting light is a function of the duty cycle of the PWM signals which determines the amount of time the LEDs are turned on in a switching period. By adjusting the amount of time the LEDs are turned on in each switching period, in other words, by modulating the duty cycle of the PWM signal, the brightness level of the LED strings 30 can be adjusted, thereby achieving dimming function.

In the present description, the "duty cycle" of a PWM Signal refers to the amount of time within a switching cycle or a switching period the PWM signal is asserted. The PWM signal is switching at a switching frequency or PWM frequency. When the PWM signal is asserted, the PWM signal has a logical value for turning on or closing the switch SW to cause LED current to flow through the respective LED channel. When the PWM signal is deasserted, the PWM signal has a logical value for turning off or opening the switch SW to stop the LED current from flowing through the respective LED channel. In the present description, the PWM signal has a logical high value when asserted and a logical low value when deasserted. The exact logical level of the PWM signal or the exact signal value of the PWM signal is not critical to the practice of the present invention. It is only necessary to understand that the duty cycle refers to the period of time the PWM signal is asserted to close the switch SW for conducting LED current.

Figure 4:
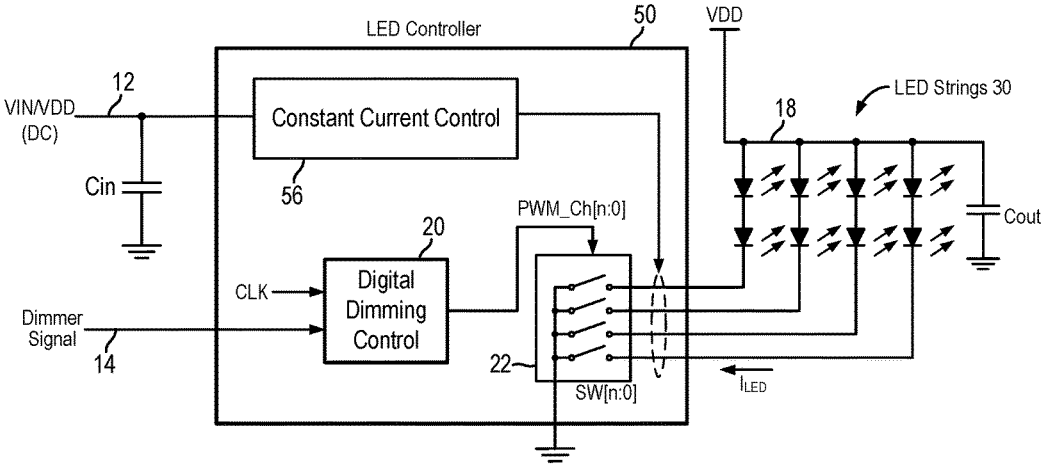
FIG. 4 is a schematic diagram illustrating an LED controller for a multiple LED channel system incorporating a digital dimming control circuit in alternate embodiments of the present invention.

FIG. 3 illustrates one configuration of the LED controller 10 where the LED controller is powered by the input voltage VIN and the LED controller generates the power rail voltage VDD (node 18) for the LED strings 30. In other embodiments, the LED strings 30 may be powered directly by the power rail voltage VDD, bypassing the LED controller. FIG. 4 is a schematic diagram illustrating an LED controller for a multiple LED channel system incorporating a digital dimming control circuit in alternate embodiments of the present invention. Like elements in FIGS. 3 and 4 are given like reference numerals and will not be further described. Referring to FIG. 4, an LED controller 50 is configured to drive a multiple LED channel system including multiple LED strings 30 connected in parallel. In the present configuration, the LED strings 30 are connected directly to the power rail VDD, that is the anode (node 18) of the LEDs are directly coupled to the power supply voltage VDD. An output capacitor Cout is coupled to filter the voltage at the anode 18 of the LED strings 30. The LED controller 50 receives an input voltage VIN on an input node 12 which can be the voltage as the power rail voltage VDD or can have a different voltage value as the power rail voltage VDD. The LED controller 50 includes a constant current control circuit 56 for controlling the LED forward current $I_{LED}$ flowing through the LED strings 30. The exact configuration of the constant current control circuit 56 is not critical to the practice of the present invention and will not be further described. It is understood that the LED controller 50, through the constant current control circuit 56, controls the magnitude of the LED forward current $I_{LED}$ to cause the LED strings to emit light at a desired light spectrum, or color.

LED controller 50 includes a digital dimming control circuit 20 to implement the LED dimming function in the same manner as described above with reference to FIG. 3. In particular, the digital dimming control circuit 20 generates PWM signals PWM_Ch[n:0] using an audible noise reduction method to control switches SW[n:0] to turn the LED strings on and off at a given duty cycle to control the brightness of the emitted light. Regardless of the overall LED system configuration, the digital dimming control circuit 20 operates in the same way to implement the LED dimming function without audible noise, as will be explained in more detail below.

As described above, the PWM dimming function is usually implemented using a PWM frequency of higher than 200 Hz. Because the desired PWM frequency of 200 Hz is within the audible range of human hearing (20 Hz to 20 KHz), the PWM dimming function can result in generation of audible noise or buzzing which is highly undesirable. The audible noise issue in LED dimming is caused by voltage ripples generated at the power supply rail VDD of the LED controller 10 at the PWM frequency that induce the input capacitor and/or the output capacitor to vibrate due to piezoelectric effect. In particular, voltage ripples can be generated on the power rail VDD when the LEDs in the LED strings are sourcing or sinking sufficiently large current as the LEDs are being turned on or off during the PWM dimming operation. During the PWM signal on or off transitions, the switches are turned on and off and positive or negative transients are generated on the power rail voltage VDD at the PWM frequency. The positive or negative transients or voltage ripples on the power supply voltage VDD, when imposed on the low cost, ceramic capacitor used as the input capacitor or the output capacitor, results in audio noise or buzzing at the PWM frequency which is within the human audible frequency range.

Figure 5:
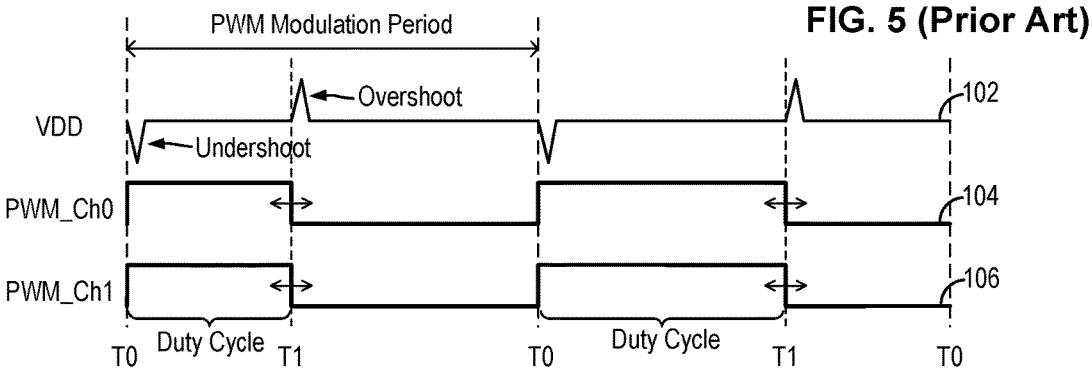
FIG. 5 (Prior Art)
FIG. 5 is a timing diagram illustrating PWM signals for PWM dimming operation in a conventional LED controller in some examples.

FIG. 5 is a timing diagram illustrating PWM signals for PWM dimming operation in a conventional LED controller in some examples. Referring to FIG. 5, PWM signals PWM_Ch0 (curve 104) and PWM_Ch1 (curve 106) for LED channel 0 and LED channel 1 are shown. The PWM signals are switching at a PWM frequency having a PWM modulation period and has a duty cycle selected according to the desired brightness. For example, the trailing edge, or high to low transition, of the PWM signals are modulated to change the duty cycle in response to the dimmer signal setting the desired light intensity level. A conventional LED controller generates PWM signals that are synchronized with each other—that is, the leading edges and the trailing edges of the PWM signals are aligned with each other. Thus, when the PWM signal for LED channel 0 PWM_Ch0 transitions from low to high at time T0, the PWM signal for LED channel 1 PWM_Ch1 also transitions from low to high at the same time. Similarly, at the end of the desired duty cycle, when the PWM signal for LED channel 0 PWM_Ch0 transitions from high to low at time T1, the PWM signal for LED channel 1 PWM_Ch1 also transitions from high to low at the same time.

The PWM signals control the on and off switching of the LEDs. With all of the PWM signal transitions occurring at the same time, the LEDs are also turning on and off at the same time, sourcing or sinking current from the power rail at the same time, causing voltage transients or voltage ripples to develop at the signal transitions, as shown in FIG. 5. Power rail VDD (curve 102) has large voltage undershoots when the PWM signals transition high and large voltage overshoots when the PWM signals transition low. These large supply voltage overshoots and undershoots induce resonance vibrations in the ceramic input and output capacitors and are the root cause of audible noise in LED lighting applications using PWM dimming functions.

In embodiments of the present invention, an LED controller, such as LED controller 10 or 50, incorporates a digital dimming control circuit 20 which implements an audible noise reduction method to reduce or eliminate audible noise generated due to voltage ripples generated during PWM dimming operation. In one embodiment, the digital dimming control circuit 20 generates a first PWM signal for a first LED channel asserted in a normal timing mode and a second PWM signal for a second LED channel asserted in a reverse timing mode. In the normal timing mode, the digital dimming control circuit 20 generates the first PWM signal for the first LED channel having the leading edge being fixed and the trailing edge being modulated based on the duty cycle. In the reverse timing mode, the digital dimming control circuit 20 generates the second PWM signal for the second LED channel having the leading edge being modulated based on the duty cycle and the trailing edge being fixed. The fixed transitions—the leading signal edge of the first PWM signal and the trailing signal edge of the second PWM signal—are lined up so that voltage transients generated by these signal transitions cancel each other out and no voltage overshoots or undershoots are generated. Eliminating the voltage transients or ripples on the power supply rail removes the source of the audible noise issue in PWM dimming function. The digital dimming control circuit therefore reduces or eliminates audible noise generated due to PWM dimming operations.

Figure 6:
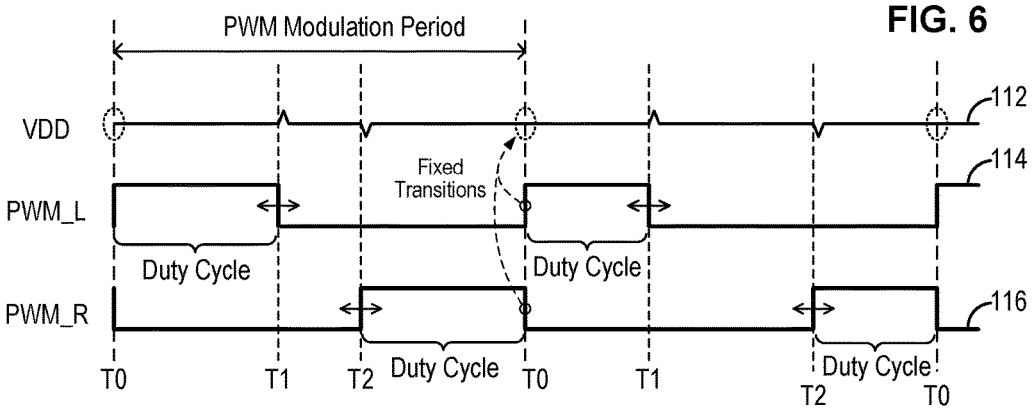
FIG. 6 is a timing diagram illustrating PWM signals for PWM dimming operation generated in accordance with the audible noise reduction method in embodiments of the present invention.

FIG. 6 is a timing diagram illustrating PWM signals for PWM dimming operation generated in accordance with the audible noise reduction method in embodiments of the present invention. The audible noise reduction method can be implemented in the digital dimming control circuit 20 in the LED controllers of FIGS. 3 and 4. Referring to FIG. 6, the audible noise reduction method of the present invention generates a pair of PWM signals for driving a pair of LED channels of LED strings. In the present embodiment, the LED channels are referred to as the left channel and the right channel. In the present description, the "left" and "right" designations are illustrative only and do not refer to specific or relative physical locations of the LED strings. Each LED channel can be formed with one or more LED strings, each LED string with one or more LEDs. More specifically, a PWM signal PWM_L (curve 114) drives the left LED channel while a PWM signal PWM_R (curve 116) drives the right LED channel.

In embodiments of the present invention, a PWM signal is generated to drive an LED channel switch at a PWM frequency having a PWM modulation period. Within a PWM modulation period, the PWM signal is asserted for a time period equal to the duty cycle and is deasserted otherwise. Within a PWM modulation period, the leading clock edge of the PWM signal is the clock transition to assert the PWM signal and the trailing clock edge of the PWM signal is the clock transition to deassert the PWM signal. The time period during which the PWM signal is asserted is the duty cycle of the PWM signal. The PWM signal can be an active high signal or an active low signal. That is, a PWM signal that is an active high signal will have a logical high value when asserted and a logical low value when deasserted. Alternately, a PWM signal that is an active low signal will have a logical low value when asserted and a logical high value when deasserted. Accordingly, the leading clock edge and the trailing clock edge can be either a low-to-high level transition or a high-to-low level transition depending on the active state of the PWM signal. In the following embodiments, the PWM signals are active high signals. Therefore, the leading edge of the PWM signal is the low-to-high level transition to assert the PWM signal for the duty cycle period and the trailing edge of the PWM signal is the high-to-low level transition to deassert the PWM signal at the end of the duty cycle period. The use of an active high PWM signal is illustrative only and not intended to be limiting. In other embodiments, the PWM signal can be an active low signal and the audible noise reduction method can be applied with appropriate changes in signal polarities.

In the present embodiment shown in FIG. 6, the audible noise reduction method generates the PWM signal PWM_L (curve 114) having the normal timing mode and is asserted at the start (T0) of the PWM modulation period. The PWM_L signal has a leading edge—the signal transition which asserts the PWM signal—that is fixed and a trailing edge that is modulated in accordance with the duty cycle. In the present illustration, time T1 denotes the end of the duty cycle of the PWM_L signal and the trailing edge of the PWM_L signal transitions to the logical low level at time T1. In the present description, a PWM signal with a normal timing mode refers to a PWM signal where the duty cycle time is counted from the leading edge. The fixed leading edge may be positioned at the start (T0) of the PWM modulation period as shown in FIG. 6 or may be positioned in other time within the PWM modulation period.

Meanwhile, the audible noise reduction method generates the PWM signal PWM_R (curve 116) having the reverse timing mode and is asserted at a time T2 of the PWM modulation period. The PWM_R signal has a leading edge—the signal transition which asserts the PWM signal—that is modulated in accordance with the duty cycle and a trailing edge that is fixed. In particular, time T2 denotes a time within the PWM modulation period to start the duty cycle of the PWM_R signal so that the end of the duty cycle is at the end of the PWM modulation period. Thus, the trailing edge of the PWM_R signal where the PWM_R signal transitions to the logical low level is at time T0 which is the end of the PWM modulation period and the start of the next PWM modulation period.

In the present description, a PWM signal with a normal timing mode refers to a PWM signal where the duty cycle time is counted from the fixed leading edge of the PWM signal. A fixed leading edge refers to initiating the leading signal transition at the same time within a switching cycle in all of the PWM switching cycles. The fixed leading edge may be positioned at the start (T0) of the PWM modulation period as shown in FIG. 6 or may be positioned in other time within the PWM modulation period. In the PWM dimming operation, the duty cycle of the PWM signals changes in response to the dimmer signal commanding certain brightness or light intensity level. For a PWM signal with a normal timing mode, the PWM signal will be asserted at the same time in all of the PWM switching cycles and will be deasserted at different times based on the duty cycle commanded by the dimmer signal.

In the present description, a PWM signal with a reverse timing mode refers to a PWM signal where the duty cycle time is counted from the fixed trailing edge of the PWM signal. A fixed trailing edge refers to ending the duty cycle of the PWM signal at the same time within a switching cycle in all of the PWM switching cycles. The fixed trailing edge may be positioned at the end (T0) of the PWM modulation period as shown in FIG. 6 or may be positioned in other time within the PWM modulation period. In the PWM dimming operation, the duty cycle of the PWM signals changes in response to the dimmer signal commanding certain brightness or light intensity level. For a PWM signal with a reverse timing mode, the PWM signal will be asserted at the different times within the PWM switching cycle based on the duty cycle commanded by the dimmer signal and the PWM signal will be deasserted at the same time in all of the PWM switching cycles.

In embodiments of the present invention, the digital dimming control circuit generates the PWM_L signal and the PWM_R signal using complementary digital signals. Because digital circuits typically have complementary signals available, generating the pair of PWM signals having normal and reverse timing modes can be accomplished using the complementary logic signals in the digital dimming control circuit, as will be explained in more detail below.

As described above, the PWM signals control the on and off switching of the LEDs. At each PWM signal transition, the LEDs within the LED channel being driven by the PWM signal are also turning on and off and sourcing or sinking current from the power rail, causing voltage transients or voltage ripples to develop at the signal transitions. With the PWM_L signal and the PWM_R signal thus generated, the fixed leading edge of the PWM_L signal transitions from low-to-high at the time T0 which is the same time as the fixed trailing edge of the PWM_R signal transitioning from high-to-low. In other words, the fixed leading edge of the PWM_L signal is lined up with the fixed trailing edge of the PWM_R signal. Because the leading edge and trailing edge of the PWM signals have opposite signal transitions—one asserting and the other one deasserting—the voltage transients generated by the PWM signals will have opposite signal polarities and the voltage transients will therefore cancel each other out. Thus, at the switching cycle boundary T0, the voltage transients on the power rail voltage VDD (curve 112) are eliminated. There will still be some voltage transients generated due to the modulated trailing and leading signal edges at time T1 and T2. However, because the modulated trailing and leading signal edges are spread out, the peak amplitude of the voltage transients is reduced. Accordingly, the digital dimming control circuit using the audible noise reduction method to generate the PWM signals achieves substantial audible noise reduction for PWM dimming operation. In many applications, once PWM frequency is fixed, time T0, being the end of one switch cycle and the start of the next switch cycle, is fixed within the audible band range. When the rising and falling edge of PWM waveforms are cancelled at time T0, the major audible noise source is eliminated. On the other hand, due to constantly modulating of brightness in many applications, the timing of T1 and T2 are varying as a function of time, which spread out audible noise further, reducing audible noise drastically.

In the above-described embodiments, the audible noise reduction method generates a pair of PWM signals for driving a pair of LED channels. The audible noise reduction method can be adapted to drive an LED system with any number of LED channels. In particular, in an LED system with multiple LED channels, the LED channels can be grouped in pairs and each pair of LED channels are driven by the pair of PWM_L signal and PWM_R signal to achieve audible noise reduction.

Figure 7:
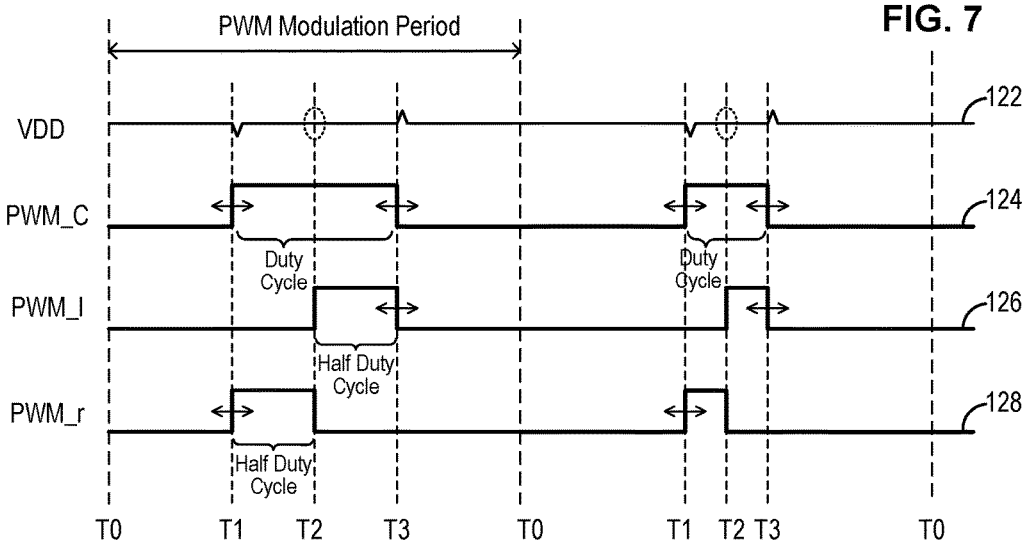
FIG. 7 is a timing diagram illustrating the PWM_C signal for PWM dimming operation generated in accordance with the audible noise reduction method of the present invention in embodiments of the present invention.

Some LED systems include three LED channels, or multiple of three channels, to drive red (R), green (G), and blue (B) LEDs. In such a system, a third PWM channel is desirable for driving its LED current without being coincidence with those of PWM_L and PWM_R waveforms in order to spread edge energy from each channel. Instead of fixed leading or trailing edge, e.g., as in PWM_L or PWM_R, the third channel can be modulated with fixed timing at the central timing of each PWM cycle, and the modulated waveform is thus named PWM_C in the following description. FIG. 7 is a timing diagram illustrating the PWM_C signal for PWM dimming operation generated in accordance with the audible noise reduction method of the present invention in embodiments of the present invention. Referring to FIG. 7, to generate the PWM signal for the PWM_C channel, the driving clock frequency is doubled, and each PWM cycle is divided into 2 portions, named PWM_1 (curve 126) and PWM_r (curve 128). Note that PWM_1 and PWM_r are two timing components, which are different from the PWM signals PWM_R and PWM_L in FIG. 6. When PWM_1 and PWM_r are combined together, the PWM signal PWM_C is generated. In the embodiment shown in FIG. 7, the audible noise reduction method generates PWM_C signal with signal transitions that are keyed off the center (T2) of the PWM modulation period. T1 and T3 are the leading and trailing edge of PWM_C in normal operation, which is varying according to the brightness change. Varying the signal transition edges help spreading energy from current transitions.

In one example, a set of three LED channels can be the red, green, and blue LEDs in a multiple channel LED system. Each LED channel can be formed with one or more LED strings, each LED string with one or more LEDs. More specifically, a PWM signal PWM_C (curve 124) of FIG. 7 drives a center LED channel, a PWM signal PWM_L (curve 114) of FIG. 6 drives the left LED channel, and a PWM signal PWM_R (curve 116) of FIG. 6 drives the right LED channel.

In a LED system with a single LED channel, the audible noise reduction method of the present invention can still be applied by using the PWM_C signal for the single LED channel. The PWM_C signal has both leading and trailing signal edges being modulated. Therefore, over the course of the PWM dimming operations, the voltage transients generated will be spread out and therefore lowering the transient voltage power.

In embodiments of the present invention, the two-channel audible noise reduction method of FIG. 6 and the three-channel audible noise reduction method by including PWM_C of FIG. 7 can be used in variable combinations to support multiple LED channel systems with various number of LED channels. For example, for a four-channel LED system, the two-channel audible noise reduction method can be used with the four LED channels being divided into two groups of two LED channels. In each group, the two LED channels are driven by the PWM_L and the PWM_R signals. In another example, for a five-channel LED system, the two-channel audible noise reduction method can be used for two of the LED channels and the three-channel audible noise reduction method can be used for the remaining three of the LED channels. Other combinations of the two-channel and three-channel audible noise reduction method can be possible to fit the need of the LED system.

Figure 8:
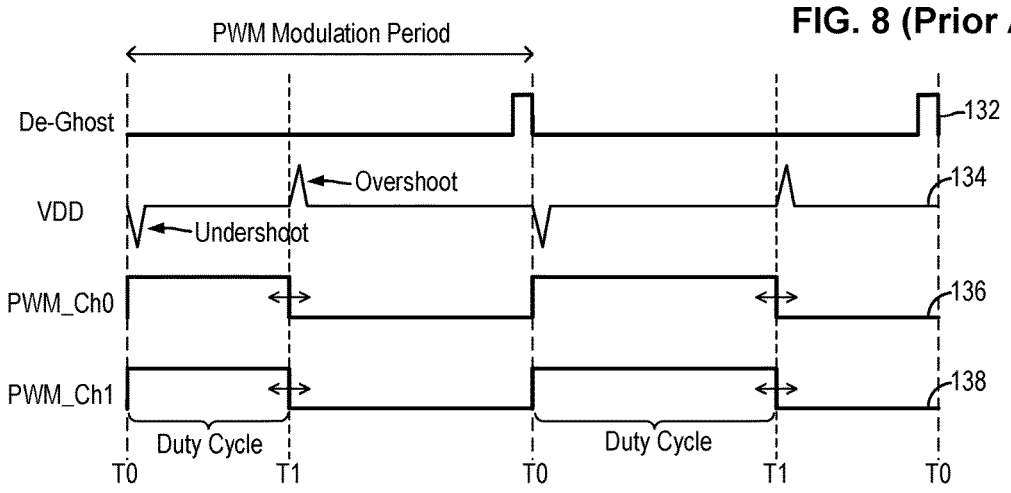
FIG. 8 (Prior Art)
FIG. 8 is a timing diagram illustrating PWM signals with de-ghosting timing for PWM dimming operation in a conventional LED controller in some examples.

In some LED systems, the LED controller is configured to drive LEDs formed in a matrix. The LEDs are scanned row by row and a small timing is often inserted at the end of the PWM switching cycle to remove ghost image by draining out residue charge on each row driver. The small timing is referred to as de-ghosting time. FIG. 8 is a timing diagram illustrating PWM signals with de-ghosting timing for PWM dimming operation in a conventional LED controller in some examples. Referring to FIG. 8, when the LED system implements de-ghosting, a de-ghost signal (curve 132) is used to insert a de-ghost time period at the end of each PWM switching cycle. In the conventional LED controller, the de-ghost time occurs at the inactive period of the PWM signals as the PWM signals are asserted at the start of each PWM switching cycle.

Figure 9:
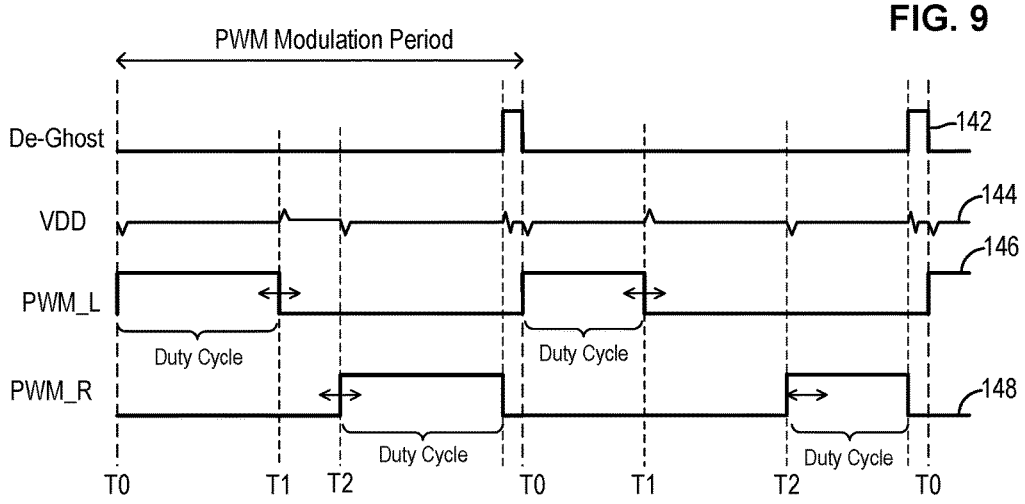
FIG. 9 is a timing diagram illustrating PWM signals for PWM dimming operation generated in accordance with the audible noise reduction method in alternate embodiments of the present invention.

In embodiments of the present invention, the audible noise reduction method can be applied in LED controllers implementing de-ghosting. FIG. 9 is a timing diagram illustrating PWM signals for PWM dimming operation generated in accordance with the audible noise reduction method in alternate embodiments of the present invention. Referring to FIG. 9, the LED controller generates a de-ghost signal (curve 142) to drain the residual charge for each LED rows. The de-ghost signal is activated at the end of each PWM modulation period. The audible noise reduction method is implemented to generate a PWM_L signal (curve 146) with a fixed leading edge asserted at time T0 and a modulated trailing edge. The audible noise reduction method is also implemented to generate a PWM_R signal (curve 148) with a fixed trailing edge asserted at time T0-δ and a modulated leading edge, where at time T0-δ, the de-ghost signal is asserted.

With the insertion of the de-ghost time, the fixed leading and trailing edges of the PWM_L and PWM_R signals do not line up exactly. Therefore, the voltage transients do not cancel out fully. However, because the signal edges are spread out, the energy of the voltage transients is still spread out and the overall audible noise power is still greatly reduced.

Figure 10:
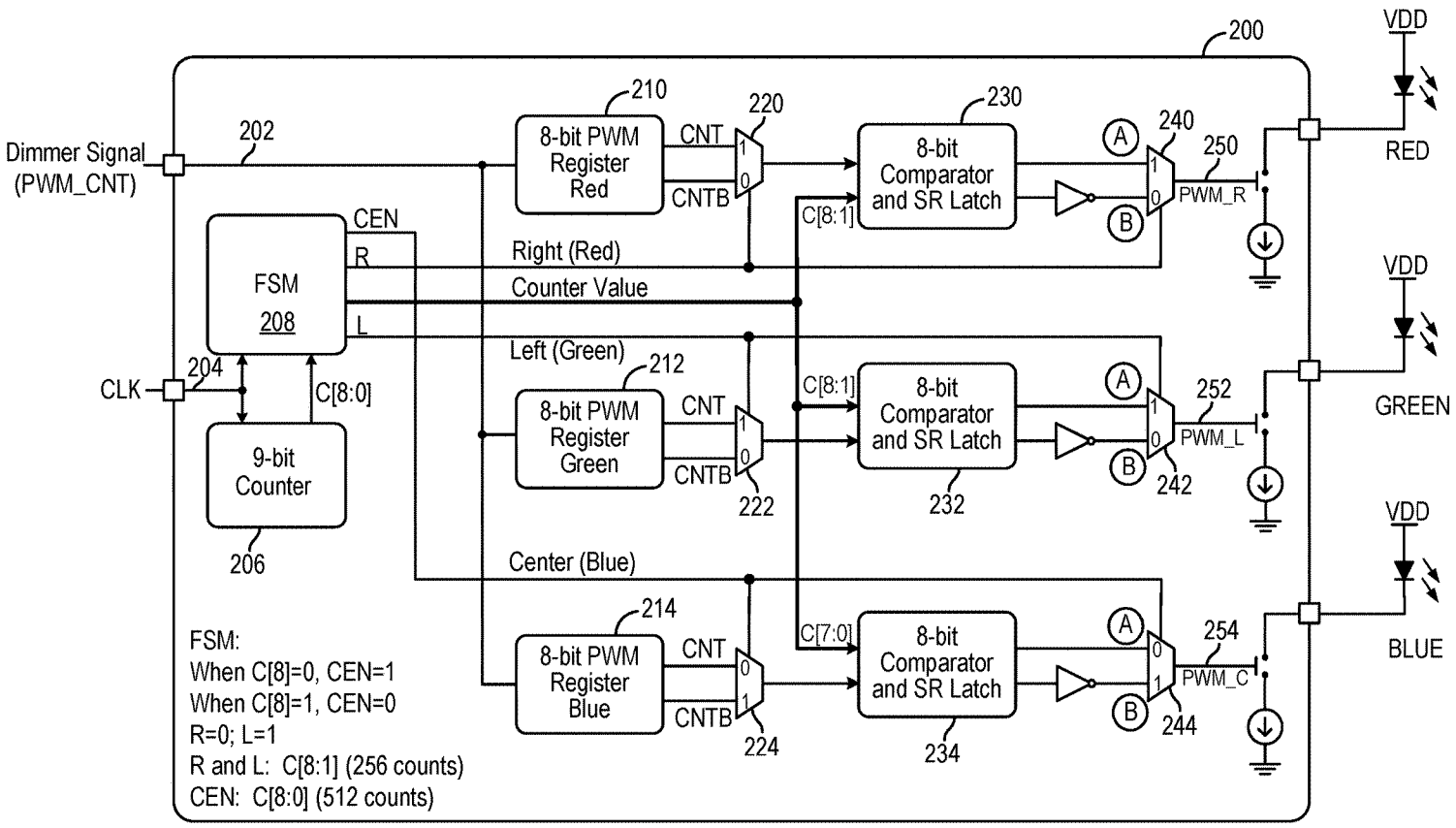
FIG. 10 is a schematic diagram of a digital dimming control circuit in some embodiments of the present invention.

FIG. 10 is a schematic diagram of a digital dimming control circuit in some embodiments of the present invention. Referring to FIG. 10, a digital dimming control circuit 200 receives the dimmer signal on an input node 202 and a clock signal CLK on an input node 204. In the present embodiment, the digital dimming control circuit 200 generates PWM signals for three LED channels. In particular, a PWM_R signal (node 250) is generated to drive a right LED channel for Red LEDs, a PWM_L signal (node 252) is generated to drive a left LED channel for Green LEDs, and a PWM_C signal (node 254) is generated to drive a center LED channel for Blue LEDs. In the present embodiment, the dimmer signal is an 8-bit signal PWM_CNT[7:0] corresponding to a count value for the programmed duty cycle. The dimmer signal is stored in PWM registers 210, 212 and 214 to be used in the respective PWM signal paths for generating the PWM signals. In the present embodiment, the PWM registers 210, 212 and 214 are 8-bit registers. In this exemplary embodiment example, all three channels are using the same architecture so that each one can be configured dynamically to be a left, right, and center channel, being controlled by the finite state machine FSM 208.

The digital dimming control circuit 200 includes a k-bit counter 206 generating counter values and a finite state machine FSM 208 generating control signals. Both the counter 206 and the FSM 208 are driven by the clock signal CLK. In the present embodiment, the counter 206 is a 9-bit counter and generating counter values C[8:0]. The FSM 208 receives the 9-bit counter values from the counter 206 and generates select signals CEN, R and L for multiplexers in the respective PWM signal paths. The FSM 208 also passes the most significant 8 bits of the counter value C[8:1] from the counter 206 to the comparators in the PWM_L and PWM_R signal paths, and passes the least significant 8 bits of the counter value C[7:0] from the counter 206 to the PWM_C signal path. For PWM_L and PWM_R channels, C[0] is not used and C[8:1] provides 256 PWM levels based on 2*CLK frequency rate. For the PWM_C channel, C[8] is used to select whether its data path is in leading or trailing edge operational mode and C[7:0] provides 256 PWM levels based on CLK frequency rate.

In the present embodiment, the FSM 208 is configured to generate the select signals as follows. When the most significant bit (MSB) of the counter value C[8] is logical low ("0"), the select signal CEN has a logical high value ("1"). When the most significant bit (MSB) of the counter value C[8] is logical high ("1"), the select signal CEN has a logical low value ("0"). The select signal R has a logical low value and the select signal L has a logical high value. Furthermore, the FSM 208 passes the most significant 8 bits of the counter values C[8:1] to the comparators in the left, right and center channel signal paths, as will be described in more detail below. In operation, the FSM 208 counts every other counter value for the left and right channel and counts every counter value for the center channel. The FSM 208 uses the least significant bit C[0] of the counter value to select the left half logic or the right half logic of the center channel. In this manner, the clock frequency for the center channel is doubled while the period is reduced by half. In one example, when the least significant bit of the counter value C[0] is 0, the FSM 208 controls the left half logic of the center channel and when the least significant bit of the counter value C[0] is 1, the FSM 208 controls the right half logic of the center channel.

The construction of the FSM 208 described above is illustrative only. One of ordinary skill in the art would appreciate that the FSM 208 can be constructed in other manner to generate select signals for multiple LED channels. For example, the FSM 208 may be configured to generate the select signals in other polarities.

The digital dimming control circuit 200 includes three signal paths—one for each of the left (green), right (red) and center (blue) channels. Each channel is constructed in the same manner including generating complementary signals—that is, non-inverted and inverted signals. The FSM 208 is configured to generate select signals of the appropriate polarities for each signal path so as to generate PWM signals in ether the normal timing mode or reverse timing mode or the center timing mode, as described in FIGS. 6 and 7. As described above, because the three signal paths are constructed identically, the three signal paths can be configured dynamically to be a left, right, and center channel, as controlled by the finite state machine FSM 208. Therefore, the specific designation of the left, right and center signal path in the present description is illustrative only and not intended to be limiting.

In the right channel signal path, the duty cycle count value PWM_CNT[7:0] is stored in a PWM register 210. The register 210 provides an non-inverting output CNT and an inverted output CNTB. The non-inverted output CNT and an inverted output CNTB of the register 210 is coupled to a two-input multiplexer 220. Multiplexer 220 receives the select signal R from FSM 208. For the right channel, the select signal R is at a logical low and therefore, the inverted duty cycle count value CNTB is selected. The inverted duty cycle count value CNTB is provided to a comparator and set-reset (SR) latch 230. In particular, the inverted duty cycle count value CNTB is compared with the counter count value at the comparator 230. More specifically, the inverted duty cycle count value CNTB is compared with the most significant 8 bits of the counter value—C[8:1]. For the right channel, the FSM 208 is counting every other count value, skipping the least significant bit. As thus configured, as the counter value C[8:1] is counting, the SR latch is set (logical high) and when the counter value C[8:1] reaches the inverted duty cycle count value CNTB, the SR latch is reset (logical low). The SR latch provides an non-inverting output "A" and an inverted output "B" which are coupled to another two-input multiplexer 240. For the right channel, the select signal R is at a logical low and therefore, the inverted output signal B is selected. The PWM_R signal generated at the output node 250 is used to control the switch coupled to the right LED channel for driving the Red LEDs. By selecting the inverted duty cycle count value and selecting the inverted SR latch output value, the right channel signal path generates a PWM signal having a modulated leading edge and a fixed trailing edge.

The left channel signal paths is constructed in similar manner. In the left channel signal path, the duty cycle count value PWM_CNT is stored in register 212. The non-inverted output CNT and an inverted output CNTB of the register 212 is coupled to a two-input multiplexer 222. Multiplexer 222 receives the select signal L from FSM 208. For the left channel, the select signal L is at a logical high and therefore, the non-inverted duty cycle count value CNT is selected. The non-inverted duty cycle count value CNT is provided to a comparator and set-reset (SR) latch 232. In particular, the non-inverted duty cycle count value CNT is compared with the counter value C[8:1] at the comparator 232. More specifically, the non-inverted duty cycle count value CNT is compared with the most significant 8 bits of the counter count value—C[8:1]. For the left channel, the FSM 208 is counting every other count value, skipping the least significant bit. As thus configured, as the counter count value C[8:1] is counting, the SR latch is set (logical high) and when the counter value C[8:1] reaches the non-inverted duty cycle count value CNT, the SR latch is reset (logical low). The SR latch provides an non-inverting output "A" and an inverted output "B" which are coupled to another two-input multiplexer 242. For the left channel, the select signal L is at a logical high and therefore, the non-inverted output signal A is selected. The PWM_L signal generated at the output node 252 is used to control the switch coupled to the left LED channel for driving the green LEDs. By selecting the non-inverted duty cycle count value and selecting the non-inverted SR latch output value, the left channel signal path generates a PWM signal having a fixed leading edge and a modulated trailing edge.

In the center channel signal path, the duty cycle count value PWM_CNT is stored in register 214. The non-inverted output CNT and an inverted output CNTB of the register 212 is coupled to a two-input multiplexer 224. Multiplexer 224 receives the select signal CEN from FSM 208. For the center channel, the select signal CEN is at a logical high when the most significant bit counter value C[8] of the counter value is at a logical low and the select signal CEN is at a logical low when the most significant bit counter value C[8] of the counter value is at a logical high. Therefore, the inverted duty cycle count value CNTB is selected during the first half of the switching cycle and the non-inverted duty cycle count value CNT is selected at the second half of the switching cycle. The selected duty cycle count value CNT is provided to a comparator and set-reset (SR) latch 234. In particular, the selected duty cycle count value CNT is compared with the counter value C[7:0] at the comparator 234. More specifically, the selected duty cycle count value CNT is compared with the least significant 8 bits of the counter count value—C[7:0]. For the center channel, the FSM 208 is counting every count value C[8:0], with the most significant bit C[8] used to select the left half logic or the right half logic of the center channel. Thus, the clock frequency of the center channel is doubled while the period is reduced to half. As thus configured, as the counter value C[7:0] is counting, the SR latch is set (logical high) and when the counter count value C[7:0] reaches the selected duty cycle count value CNT/CNTB, the SR latch is reset (logical low). The SR latch output is coupled to another two-input multiplexer 244. The multiplexer 244 selects the output signal based on the select signal C and provides the inverting output "B" at the first half of the switching cycle and provides the non-inverting output "A" at the second half of the switching cycle. The PWM_C signal generated at the output node 254 is used to control the switch coupled to the center LED channel for driving the blue LEDs. By selecting either the non-inverted and the inverted duty cycle count values and selecting either the non-inverted and inverted SR latch output value and by doubling the clock rate, the center channel signal path generates a PWM signal centered in the middle of the switching cycle and having a modulated leading and trailing edges. For instance, the center channel can be seen as the combination of the left channel and the right channel.

In the embodiment shown in FIG. 10, the digital dimming control circuit 200 is constructed using three signal paths. The construction of the digital dimming control circuit 200 in FIG. 10 is illustrative only and not intended to be limiting. In other embodiments, the digital dimming control circuit of the present invention can be constructed using one or more signal paths. The finite state machine is constructed accordingly to generate control signals for the number of signal paths in the digital dimming control circuit. In most cases, the digital dimming control circuit will include two or more signal paths supporting two or more LED channels.

Figure 11:
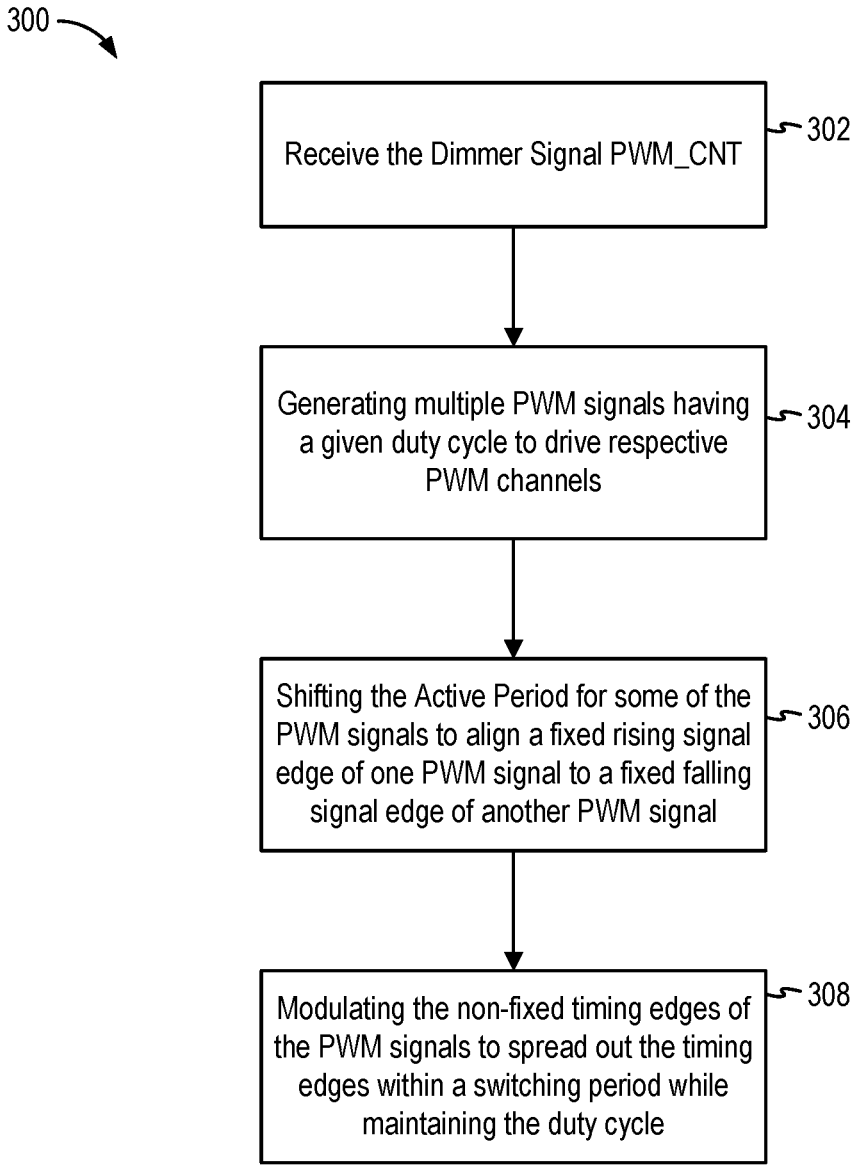
FIG. 11 is a flow chart illustrating the audible noise reduction method which can be implemented in a digital dimming control circuit in embodiments of the present invention.

FIG. 11 is a flow chart illustrating the audible noise reduction method which can be implemented in a digital dimming control circuit in embodiments of the present invention. Referring to FIG. 11, an audible noise reduction method 300 receives a dimmer signal being a count value PWM_CNT indicative of the duty cycle to be programmed (302). The method 300 generates multiple PWM signals having a given duty cycle to drive respective PWM channels (304). The method 300 generates the PWM signals by shifting the active period for some of the PWM signals to align a fixed rising signal edge of one PWM signal to a fixed falling signal edge of another PWM signal (306). In this manner, the power rail voltage transients generated by these fixed signal edges are cancelled out. The method 300 further generates the PWM signals by modulating the non-fixed timing edges of the PWM signals to spread out the timing edges within a switching period or switching cycle (308). In this manner, the power supply transients are spread out within the switching period to reduce the peak amplitude of the voltage transients. Meanwhile, the duty cycle of each of the PWM signals is maintained to be the same so that the programmed brightness level is not affected by shifting of the signal edges (308).

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A method in a light-emitting diode (LED) controller for generating control signals for driving multiple LED channels implementing LED dimming function using pulse width modulation (PWM), the method comprising:

generating a first PWM signal to drive a first LED channel to turn on and off the first LED channel within a switching cycle at a PWM frequency, the first PWM signal having a leading edge being asserted to turn on the first LED channel and a trailing edge being deasserted to turn off the first LED channel;

generating a second PWM signal to drive a second LED channel to turn on and off the second LED channel within the switching cycle at the PWM frequency, the second PWM signal having a leading edge being asserted to turn on the second LED channel and a trailing edge being deasserted to turn off the second LED channel;

receiving a dimmer signal having a value indicative of a duty cycle for turning on the first and second LED channels;

generating the first PWM signal for driving the first LED channel having the leading edge being a fixed signal transition at a first time location and the trailing edge being a signal transition being modulated to generate the first PWM signal having the duty cycle in response to the dimmer signal; and generating the second PWM signal for driving the second LED channel having the trailing edge being a fixed signal transition at the first time location and the leading edge being a signal transition being modulated to generate the second PWM signal having the duty cycle in response to the dimmer signal.

2. The method of claim 1, wherein the first time location comprises a start of the switching cycle which is also an end of the switching cycle.

3. The method of claim 1, further comprising:

generating a third PWM signal to drive a third LED channel to turn on and off the third LED channel within the switching cycle at the PWM frequency, the third PWM signal having a leading edge being asserted to turn on the third LED channel and a trailing edge being deasserted to turn off the third LED channel, the third PWM signal having the leading edge and the trailing edge both being signal transitions being modulated to generate the third PWM signal having the duty cycle in response to the dimmer signal.

4. The method of claim 3, wherein generating the third PWM signal comprises:

generating the third PWM signal for driving the third LED channel to have an active period centered at the center of the switching cycle, the modulating leading edge of the third PWM signal being positioned in a first half of the switching cycle before the center of the switching cycle and the modulating trailing edge of the third PWM signal being positioned in a second half of the switching cycle after the center of the switching cycle.

5. The method of claim 1, wherein the LED controller implements a de-ghost signal at the end of each switching cycle, the de-ghost signal having a de-ghost time duration, and wherein the second PWM signal has the trailing edge being a fixed signal transition at a time location being the de-ghost time duration before the first time location.

6. The method of claim 1, further comprising:

generating a plurality of PWM signals for driving a plurality of LED channels, each PWM signal driving one LED channel, the plurality of PWM signals comprising a plurality of pairs of the first PWM signal and the second PWM signal.

7. The method of claim 3, further comprising:

generating a plurality of PWM signals for driving a plurality of LED channels, each PWM signal driving an LED channel, the plurality of PWM signals comprising a plurality of groups of the first PWM signal, the second PWM signal and the third PWM signal.

8. A method in a light-emitting diode (LED) controller for generating control signals for driving multiple LED channels implementing LED dimming function using pulse width modulation (PWM), the method comprising:

generating a first PWM signal to drive a first LED channel to turn on and off the first LED channel within a switching cycle at a PWM frequency, the first PWM signal having a leading edge being asserted to turn on the first LED channel and a trailing edge being deasserted to turn off the first LED channel;

receiving a dimmer signal having a value indicative of a duty cycle for turning on the first LED channel; and generating the first PWM signal for driving the first LED channel having both the leading edge and the trailing edge as signal transitions being modulated to generate the first PWM signal having the duty cycle in response to the dimmer signal.

9. The method of claim 8, wherein generating the first PWM signal comprises:

generating the first PWM signal for driving the first LED channel to have an active period centered at the center of the switching cycle, the modulating leading edge of the first PWM signal being positioned in a first half of the switching cycle before the center of the switching cycle and the modulating trailing edge of the first PWM signal being positioned in a second half of the switching cycle after the center of the switching cycle.

10. The method of claim 8, further comprising:

generating a second PWM signal being switched at the PWM frequency for driving a second LED channel, the second PWM signal having the leading edge being a fixed signal transition at a first time location and the trailing edge being a signal transition being modulated to generate the second PWM signal having the duty cycle in response to the dimmer signal; and generating a third PWM signal being switched at the PWM frequency for driving a third LED channel, the third PWM signal having the leading edge being a signal transition being modulated to generate the third PWM signal having the duty cycle in response to the dimmer signal and a trailing edge being a fixed signal transition at the first time location.

11. The method of claim 10, wherein the first time location comprises a start of the switching cycle which is also an end of the switching cycle.

12. The method of claim 10, further comprising:

generating a plurality of PWM signals for driving a plurality of LED channels, each PWM signal driving an LED channel, the plurality of PWM signals comprising a plurality of groups of the first PWM signal, the second PWM signal and the third PWM signal.

13. The method of claim 10, wherein generating the first, second and third PWM signals comprise generating the first, second and third PWM signals simultaneously.

14. A digital dimming control circuit in a light-emitting diode (LED) controller for generating control signals for driving multiple LED channels implementing LED dimming function using pulse width modulation (PWM), the control circuit comprising:

a first digital signal path configured to generate a first PWM signal to drive a first LED channel to turn on and off the first LED channel within a switching cycle at a PWM frequency in response to a dimmer signal, the dimmer signal having a value indicative of a duty cycle for turning on the first LED channel, the first PWM signal having a leading edge being asserted to turn on the first LED channel and a trailing edge being deasserted to turn off the first LED channel, the first digital signal path being configured to generate the first PWM signal having the leading edge being a fixed signal transition at a first time location and the trailing edge being a signal transition being modulated to generate the first PWM signal having the duty cycle in response to the dimmer signal; and a second digital signal path configured to generate a second PWM signal to drive a second LED channel to turn on and off the second LED channel within the switching cycle at the PWM frequency in response to the dimmer signal, the dimmer signal having a value indicative of a duty cycle for turning on the second LED channel, the second PWM signal having a leading edge being asserted to turn on the second LED channel and a trailing edge being deasserted to turn off the second LED channel, the second digital signal path being configured to generate the second PWM signal having the trailing edge being a fixed signal transition at the first time location and the leading edge being a signal transition being modulated to generate the second PWM signal having the duty cycle in response to the dimmer signal.

15. The digital dimming control circuit of claim 14, wherein the first time location comprises a start of the switching cycle which is also and an end of the switching cycle.

16. The digital dimming control circuit of claim 14, further comprising:

a third digital signal path configured to generate a third PWM signal to drive a third LED channel to turn on and off the third LED channel within the switching cycle at the PWM frequency in response to the dimmer signal, the dimmer signal having a value indicative of a duty cycle for turning on the third LED channel, the third PWM signal having a leading edge being asserted to turn on the third LED channel and a trailing edge being deasserted to turn off the third LED channel, the third digital signal path being configured to generate the third PWM signal having the leading edge and the trailing edge both being signal transitions being modulated to generate the third PWM signal having the duty cycle in response to the dimmer signal.

17. The digital dimming control circuit of claim 16, wherein the third PWM signal has an active period centered at the center of the switching cycle, the modulating leading edge of the third PWM signal being positioned in a first half of the switching cycle before the center of the switching cycle and the modulating trailing edge of the third PWM signal being positioned in a second half of the switching cycle after the center of the switching cycle.

18. The digital dimming control circuit of claim 14, wherein the LED controller implements a de-ghost signal at the end of each switching cycle, the de-ghost signal having a de-ghost time duration, and wherein the second PWM signal has the trailing edge being a fixed signal transition at a time location being the de-ghost time duration before the first time location.

19. The digital dimming control circuit of claim 14, wherein the plurality of digital signal paths generates a plurality of PWM signals for driving the plurality of LED channels, each PWM signal driving one LED channel, the plurality of PWM signals comprising a plurality of pairs of the first PWM signal and the second PWM signal.

20. The digital dimming control circuit of claim 16, wherein the plurality of digital signal paths generates a plurality of PWM signals for driving the plurality of LED channels, each PWM signal driving one LED channel, the plurality of PWM signals comprising a plurality of groups of the first PWM signal, the second PWM signal and the third PWM signal.

* * * * *